United States Patent [19]

Frank

[11] 4,346,751

[45] Aug. 31, 1982

[54] FOUNDRY MOLDS

[75] Inventor: Earl E. Frank, Tallman, N.Y.

[73] Assignee: Abex Corporation, New York, N.Y.

[21] Appl. No.: 836,376

[22] Filed: Sep. 26, 1977

[51] Int. Cl.[3] ..... B22C 9/10
[52] U.S. Cl. ..... 164/368; 164/31
[58] Field of Search ..... 164/365–368, 164/354, 31

[56] References Cited

U.S. PATENT DOCUMENTS 340,043 4/1886 Harris ..... 164/366
546,948 9/1895 Watt ..... 164/354

*Primary Examiner*—R. L. Spruill
*Assistant Examiner*—K. Y. Lin
*Attorney, Agent, or Firm*—Kinzer, Plyer, Dorn & McEachran

[57] ABSTRACT

Hand patching of recesses in the side walls of a sand mold, intended to receive a core, is avoided by filling the recess, after the core is emplaced with a complemental pre-molded cover.

1 Claim, 6 Drawing Figures

FOUNDRY MOLDS

This invention relates to the foundry arts and in particular to a sand mold in which cores are supported.

Massive castings are sometimes produced in the as-cast form with openings enabling bolts to be employed in field installations as an incident to securing the casting for service use.

In some cases the casting may require as many as twenty or more bolts. The sand mold must be properly prepared for receiving the cores which will afford the openings in the casting. For example, in the instance where the bolts will extend transverse to the longitudinal axis of the casting, the side walls of the sand drag (mold) are provided with recesses or pockets when the sand is rammed about the pattern. The pockets extend downward from the parting line. After the pattern is removed, the cores are set in the pockets and then it is necessary to patch the rest of the pocket not occupied by core. The job must be done carefully, especially to be sure the patch work matches the parting line. This is done by hand, using patching sand, for as many pockets as cores. In addition, depending on the nature of the casting, it is sometimes necessary to match the patch work to small recesses in the drag, adjacent the pocket, where special contours are required in the casting.

The labor costs required for such patch work are large and the primary object of the present invention is to increase productivity by eliminating the need for patchwork.

IN THE DRAWING

Figure 1:
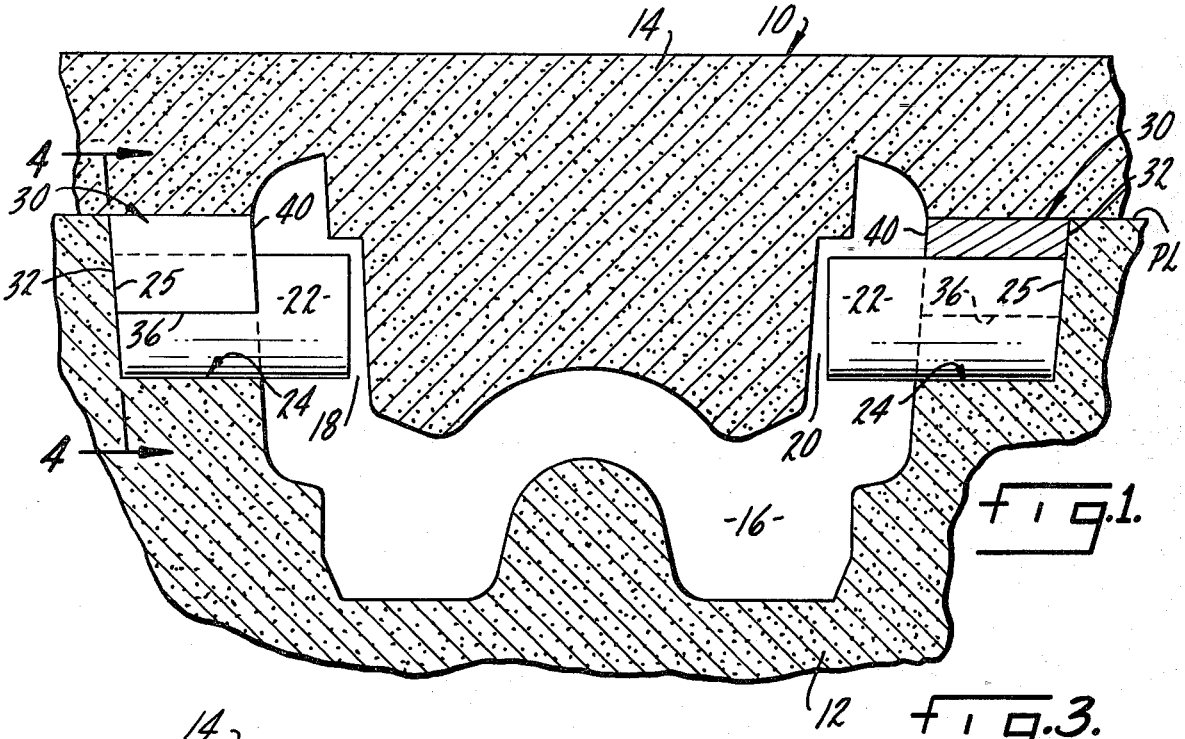
FIG. 1 is a fragmentary sectional view of a sand mold incorporating features of the present invention.

Referring to FIG. 1, this shows a fragment of a sand mold 10 including both the drag 12 and the superimposed cope 14, together defining a casting cavity 16. The cope and drag engage at the usual parting line PL.

It is assumed the casting is to have openings in the opposed side walls thereof which result from metal being cast in the opposed portions 18 and 20 of the casting cavity. To obtain such openings, cylindrical stub cores 22 are positioned in corresponding recesses 24 formed in the opposed side walls of the drag 12. Thus, when the pattern (not shown) is employed to produce the desired contour in the mold drag, the same pattern is provided with lateral projections which at the same time shape each recess as 24 and in this connection it may be noted that each core as 22 will be centered in the recess with its free end extending into the casting cavity and with the opposed end fitting flush against the end wall 25 of the recess which receives the core.

Figure 6:
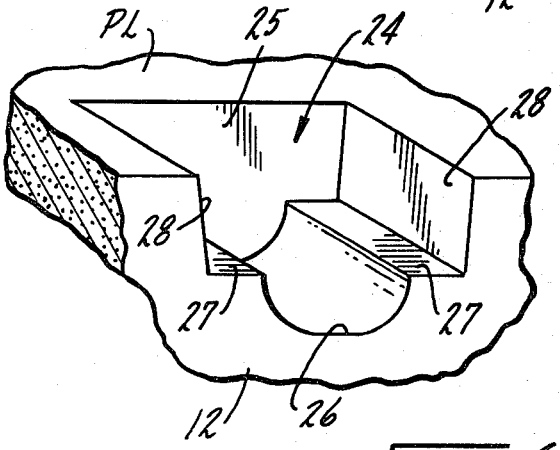
FIG. 6 is a fragmentary perspective view of the pocket area of the mold of receiving a core.

FIG. 6 shows the recess 24 without the core in it. The recess, more specifically, has an end wall 25, as already noted, a concave bottom pocket 26 shaped complemental to the underside of the core, a pair of horizontal shoulders or ledges as 27 and a pair of vertical side walls as 28. The end wall 25 and side walls 28 terminate at the parting line.

In the prior practice, the drag was provided with as many pockets as cores (that is, there was a pocket as 26 for each core) and after the core was positioned in a pocket it was necessary to fill the remainder of the core pocket with patching sand carefully applied so that the top of the core pocket would be flush with the parting line PL, FIG. 1, where the cope sets on the drag. In an instance where the casting is to present a thickened or enlarged pad of metal surrounding the opening afforded by the core then the side wall may be specially contoured wherefor it was also required that the patching sand be so applied as not to interfere with such contouring.

Assuming a great many openings, requiring cores, are involved and that some if not all of the corresponding core pockets merge into other recesses in the drag, it can be readily visualized a great deal of manual labor is required to administer the patching work in accordance with prior practice.

Under and in accordance with the present invention, patch work of the kind explained above is completely eliminated and this is achieved by placing in each recess as 24 a pre-molded cover 30 of such form and dimension as to fill the remaining portion of the core recess not occupied by the core itself. Also, the top of the cover 30 will lie in the plane of the parting line PL.

Figure 5:
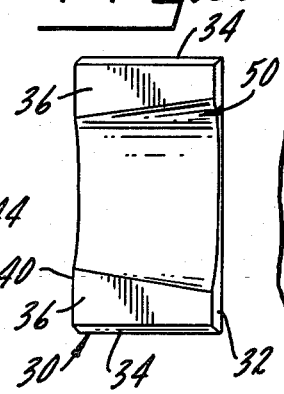
FIG. 5 is a view of the underside of a core cover.
Figure 3:
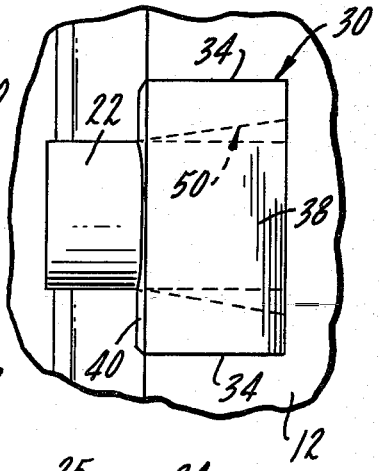
FIG. 3 is a detail plan view of one of the core covers and the associated core.

As shown in FIGS. 3 and 5, each cover is rectangular in plan of a size to neatly fit the core recess, filling the recess up to but not above the parting line and extending out to but not extending into the casting cavity. Thus, each cover has an end face 32 engaging the end wall 25 of the core recess, side faces 34 engaging the side walls 28 of the core recess, bottom ledges 36 adapted to rest on the shoulders 27, a top wall 38 flush with the parting line PL, and an inner end face 40 flush with the outer limit of the casting cavity. Also, the underside of the cover has a concave recess fitting the top of the core as will be explained in more detail below.

Figure 2:
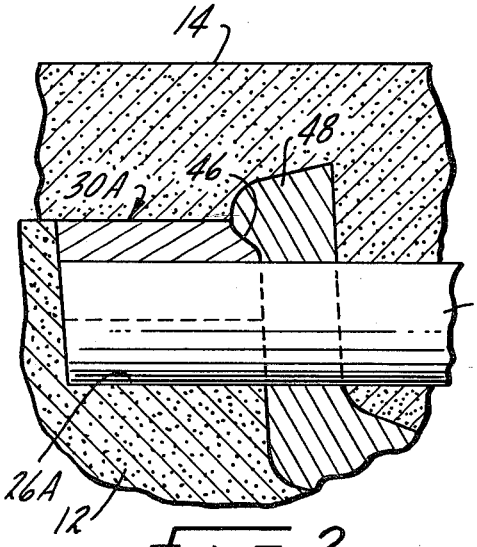
FIG. 2 is a detail view showing a modified form of cover for a core.

In an instance where the openings are to extend entirely through both side walls of the casting, and when there is no interference by an intermediate cast section, the core may be a lone one, of sufficient length that its opposed ends rest in axially aligned pockets in the opposed side walls of the drag. A through-opening of this character is shown in FIG. 2. One end portion of the corresponding core 44 sets in a core pocket 26A and the opposite end (not shown) of the same core would set in a corresponding pocket in the opposite side of drag side wall, not shown. Also, as shown in FIG. 2, the cover 30A, instead of having a flat end facing the casting cavity, may have a curvature as 46 therein, imparting a corresponding curvature to the casting identified by reference character 48. The cover 30A is otherwise identical to cover 30.

Figure 4:
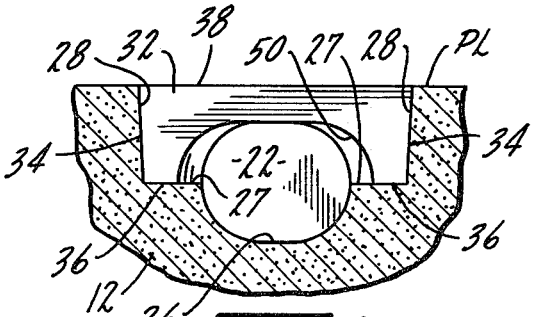
FIG. 4 is an end view on the line 4—4 of FIG. 1.

The openings in the casting provided by the coring may not always be perpendicular to the longitudinal axis of the casting. Thus it may be required that the bolts or other elements to extend through the openings in the casting do so at an angle, requiring corresponding angularity in the position of the core relative to the longitudinal axis of the casting. Thus, as shown in FIGS. 3, 4 and 5, the concave underside of the cover 30 which complementally caps the top of the core is formed with a tapered recess 50. The recess 50 is widest at the inner end where the cover fits against the end wall 25 and is most narrow at the opposite end adjacent the casting cavity. Indeed the narrow end of the recess 50 has a width corresponding to that of the core itself, thereby allowing a core to be located at an appropriate angle in the core receiving pocket.

The castings will represent standard dimensions. According, it is only necessary to pre-mold covers as 30 in a core box and then set these in place, all easily accomplished as a routine matter which is to be compared to the previous practice of hand patching around the cores.

I claim:

1. A sand mold drag having opposed side walls separated by a casting cavity, each side wall of the drag having an upper parting line surface with a plurality of core receiving recesses extending downwardly therefrom, each recess presenting a bottom pocket of sand for receiving the core and also presenting a pair of sand shoulders outward of and in communication with said pocket on opposite sides thereof for supporting a cover, each recess having one end opening into the casting cavity, the core resting in said pocket and only partially filling the remainder of the related recess so that said shoulders are free of the core, and a one-piece premolded cover set atop and in contact with each core with a pair of spaced bottom ledges of the cover resting on said shoulders substantially to fill the remainder of each drag recess, each cover having an underside concave recess fitting the top of the related core and having a flat top surface flush with the parting line surface of the related mold side wall, wherein said concave recess in each cover is tapered from a narrow width at the end adjacent the casting cavity to a wider width at the opposite end.

* * * * *